US006055975A

United States Patent [19]

Gallagher et al.

[11] Patent Number: 6,055,975

[45] Date of Patent: May 2, 2000

[54] PAINTBALL CONTAINER

[75] Inventors: Wayne J. Gallagher, Redford; Phillip P. Donahue, Wolverine Lake; James M. Adams, Southfield; Robert F. Combs, Sterling Heights, all of Mich.

[73] Assignee: The Paintball Emporium, Inc., Wolverine Lake, Mich.

[21] Appl. No.: 09/126,548

[22] Filed: Jul. 30, 1998

[51] Int. Cl.[7] ..... F41B 11/02

[52] U.S. Cl. ..... 124/50; 124/49; 141/382; 221/185; 222/175

[58] Field of Search ..... 124/49, 50, 56, 124/73; 141/382; 221/185; 222/175, 460, 527, 528, 529, 567

[56] References Cited

U.S. PATENT DOCUMENTS

| | | | |
|---|---|---|---|
| 54,147 | 4/1866 | Hammond . | |
| 467,074 | 1/1892 | Anderson et al. | 222/175 |
| 1,617,273 | 2/1927 | Piquet | 222/567 |
| 1,927,424 | 9/1933 | Trubenbach et al. . | |
| 1,955,559 | 4/1934 | Narrow | 124/49 X |
| 2,599,118 | 6/1952 | McMillan | 222/175 |
| 2,681,529 | 6/1954 | Braithwaite | 221/185 X |
| 2,973,124 | 2/1961 | Reese | 222/527 X |
| 3,070,272 | 12/1962 | Warman . | |
| 3,263,664 | 8/1966 | Bauer et al. . | |
| 3,996,916 | 12/1976 | Koehn . | |
| 4,020,974 | 5/1977 | Bauer et al. | 124/50 X |
| 4,141,558 | 2/1979 | Hoffman | 124/50 X |
| 4,967,723 | 11/1990 | Cutrell | 124/50 |
| 5,086,948 | 2/1992 | Slusarz | 221/185 |
| 5,097,816 | 3/1992 | Miller . | |
| 5,166,457 | 11/1992 | Lorenzetti | 124/49 X |
| 5,248,089 | 9/1993 | Bekius . | |
| 5,282,454 | 2/1994 | Bell et al. . | |
| 5,360,142 | 11/1994 | Stern et al. . | |
| 5,503,090 | 4/1996 | Guzan | 222/175 X |
| 5,673,679 | 10/1997 | Walters | 124/49 X |
| 5,722,383 | 3/1998 | Tippmann et al. . | |
| 5,791,325 | 8/1998 | Anderson | 124/49 X |
| 5,809,983 | 9/1998 | Stoneking | 124/50 |

*Primary Examiner*—John A. Ricci

[57] ABSTRACT

A high volume reservoir is adapted to hold up to 1000 or more paintballs. A harness or pack is provided to allow the reservoir to be unobtrusively carried by the operator of a paintball marker. A conduit is adapted to extend between the reservoir and paintball marker to continuously or selectively feed paintballs into the marker. A valve assembly mounted on the end of the conduit allows an operator to simultaneously load and fire the paintball marker.

29 Claims, 3 Drawing Sheets

FIG 1
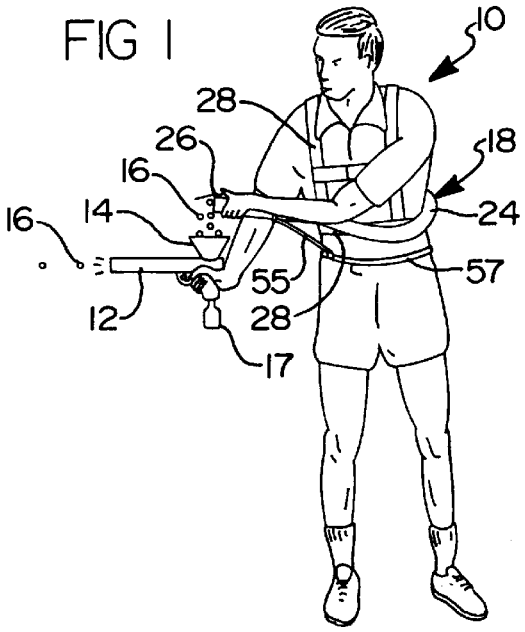
FIG 2
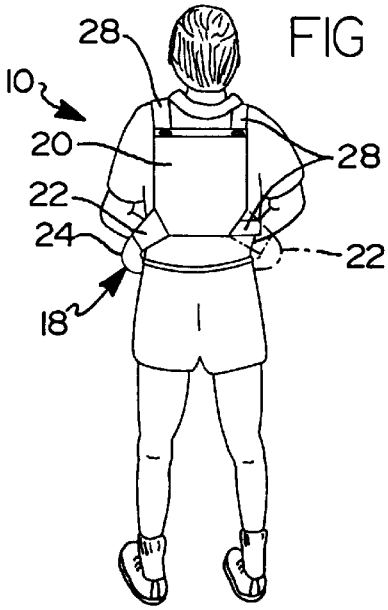
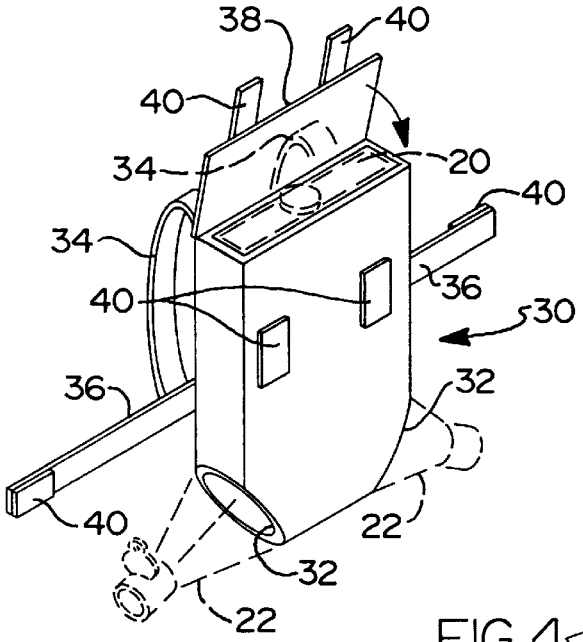
FIG 3
FIG 4
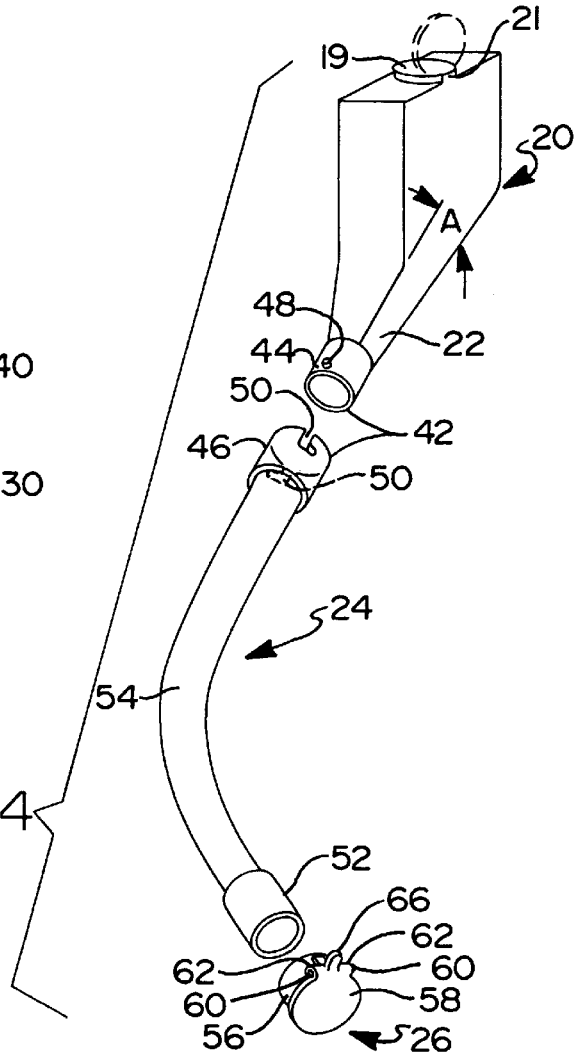

FIG 5
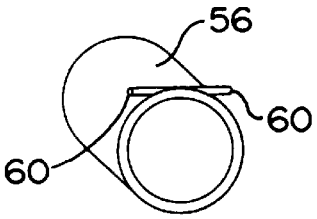
FIG 6
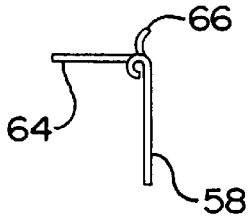
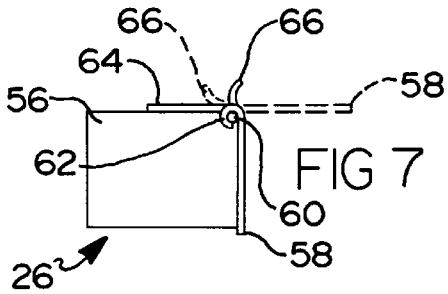
FIG 7
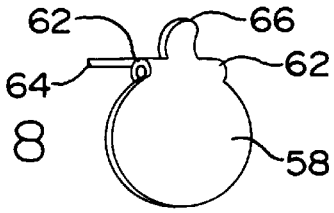
FIG 8
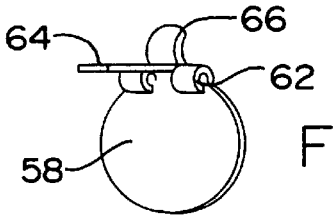
FIG 9
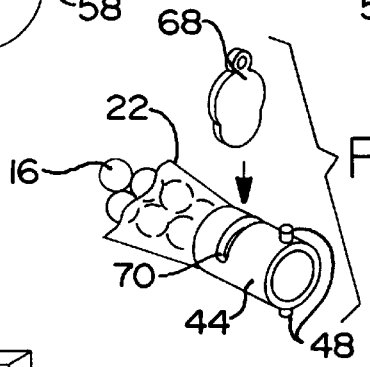
FIG 10
FIG 12
PRIOR ART
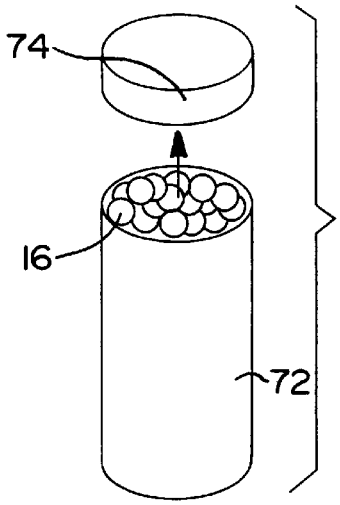
FIG 11
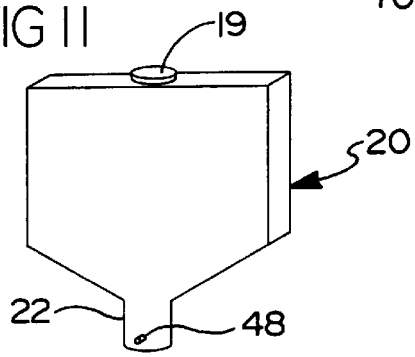
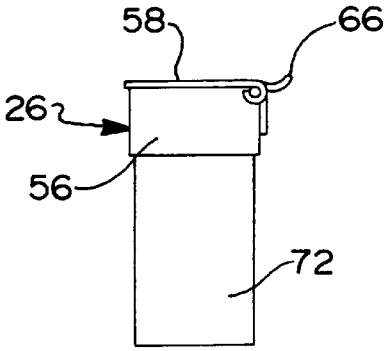
FIG 13
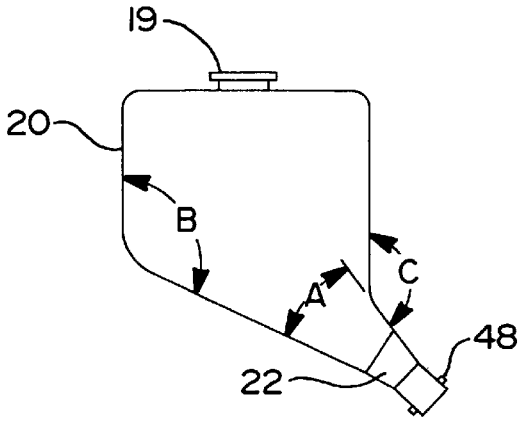
FIG 14

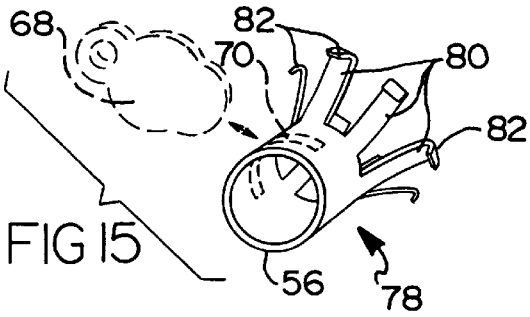
FIG 15
FIG 16
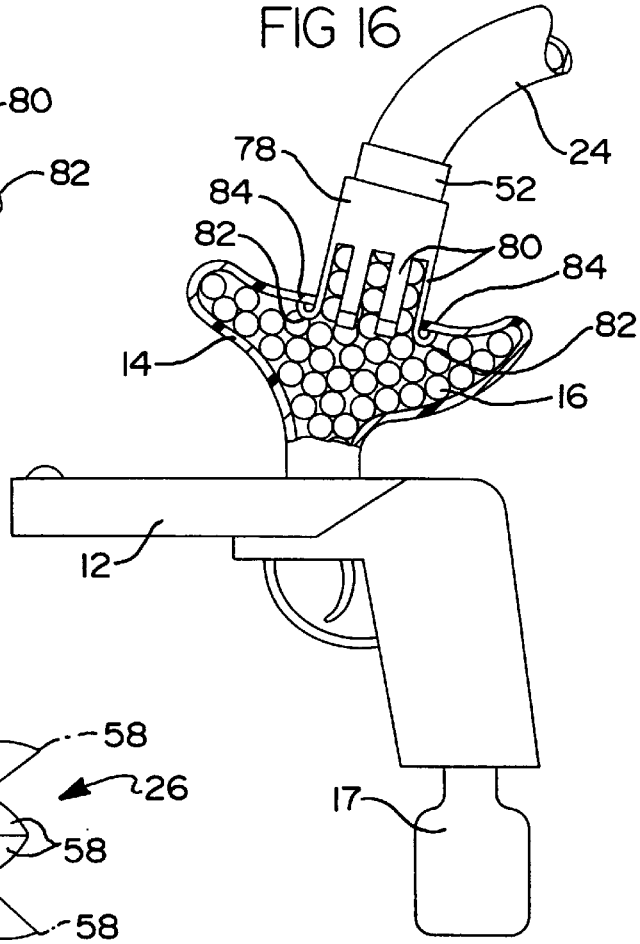
FIG 17
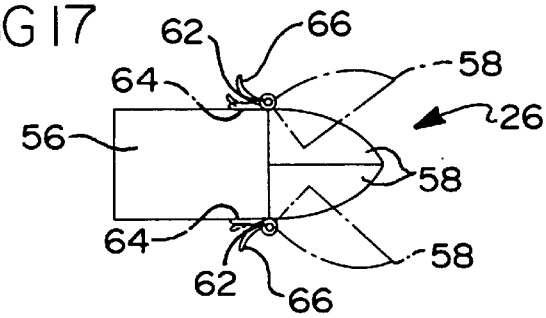
FIG 18
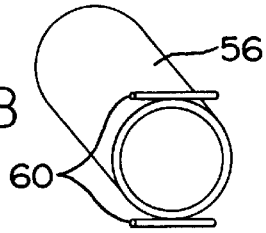
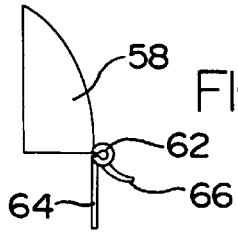
FIG 19
FIG 21
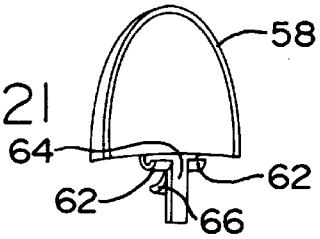
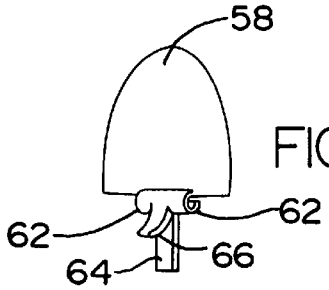
FIG 20

PAINTBALL CONTAINER

BACKGROUND OF THE INVENTION

1. Field of the Invention

The present invention relates in general to a method and apparatus for holding and dispensing ammunition, and in particular to a high volume reservoir adapted to be carried by a user for loading paintballs into the hopper of a paintball marker.

2. Description of Prior Developments

When engaged in any one of the numerous varieties of paintball games, one player attempts to hit another player with a spherical ball containing paint or some other type of marking material discharged from a compressed air or gas operated marking device. It is often advantageous to be able to fire rapidly and continuously in order to increase the chances of hitting an opponent with a paintball.

Although the compressed gas cylinders used to propel the paintballs can provide up to 1000 or more individual charges or shots, the magazines or hoppers attached to the paintball markers typically are limited to holding only about one or two hundred paintballs. This can create an undesirable situation wherein a player has sufficient compressed gas to continue shooting, but runs out of paintball ammunition.

In this case, a player without paintball ammunition is particularly vulnerable insofar as the distinctive sound of a paintball marker being fired with an empty hopper is easily recognized by other players. As a result, an opponent can rush upon and shoot the player with the empty marker without risk of being shot by that player.

In order to reduce the chance of being caught with an empty paintball hopper, paintball canisters holding about 100 paintballs have been made available to paintball enthusiasts. Several of these canisters are typically carried on a belt and are removed, opened and emptied into a paintball marker hopper before the hopper runs out of paintballs.

While such canisters provide an advantage, they are often difficult to access, open and dispense. Moreover, the opening of these canisters usually requires the use of two hands and thereby temporarily renders the player defenseless.

Another drawback associated with such canisters is the problem of their proper disposal. Once emptied, the canisters present disposal and potential safety issues. Proper disposal of the canister requires a player to reapply the canister's cap or cover and place it back into a pouch on the player's belt. As with dispensing the paintballs into a paintball marker hopper, this leaves the player defenseless for a brief period of time, thus providing more opportunity for an opposing player to score a mark.

An alternate means of disposal would be for the player to throw the empty canister on the ground in the playing area for later retrieval. This method can pose a safety problem. In the heat of action, a player, other team members or opponents could step on an empty canister, causing them to fall.

Accordingly, a need exists for a method and apparatus for dispensing paintballs into the hopper of a paintball marker without interrupting the firing of the marker. Another need exists for a method and apparatus for reloading a paintball marker while allowing the paintball marker operator to continue shooting during reloading.

Still another need exists for a method and apparatus for reloading a paintball marker with one hand while holding and firing the paintball marker with the other hand.

Yet another need exists for a method and apparatus for storing and dispensing up to 1000 or more paintballs so that the paintball gas cylinder and paintball storing and dispensing apparatus can be replaced simultaneously with both the gas cylinder and storing and dispensing apparatus being subsequently exhausted substantially simultaneously.

Another need exists for a paintball storing and dispensing apparatus which can be easily carried on the body of a paintball marker operator and which does not interfere with or obstruct the use of the paintball marker.

Another need exists for a paintball storing and dispensing apparatus which can be easily reloaded and reused without creating unnecessary downtime or potential hazards by throwing empty canisters on the playing area.

SUMMARY OF THE INVENTION

The present invention has been developed to fulfill the needs noted above and therefore has as an object the provision of a method and apparatus for storing and dispensing up to 1000 or more paintballs using a single paintball reservoir.

Another object of the invention is the provision of a method and apparatus for storing and dispensing paintballs into the hopper of a paintball marker in such a manner as to allow the paintball marker operator to continue firing the paintball marker during reloading.

Still another object of the invention is the provision of a reusable and reloadable paintball storing and dispensing device which is easily and unobtrusively carried by a paintball marker operator and which may be operated to reload a paintball marker with one hand while the operator continues shooting with the other hand.

These and other objects are met by the method and apparatus of the present invention which includes a reservoir adapted to hold and dispense up to 1000 or more paintballs. The reservoir may be carried on the body of the paintball operator with the aid of a harness or carrying pack.

A flexible conduit is provided on the reservoir to smoothly transfer paintballs from the reservoir to a hand operated dispensing valve. The valve may be opened and closed with one hand so as to allow the operator to dispense paintballs through the valve while continuing to fire the paintball marker with the other hand. This eliminates the drawback of other paintball reloaders which render a paintball marker operator virtually defenseless during reloading.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings:

FIG. 1 is a schematic front perspective view of a paintball marker operator using a paintball dispensing apparatus in accordance with the invention;

FIG. 2 is a rear view of FIG. 1, and further showing an alternate arrangement of the dispensing apparatus in broken lines;

FIG. 3 is a perspective view of the harness and carrying pouch of FIGS. 1 and 2;

FIG. 4 is an exploded perspective view of the paintball dispensing apparatus of FIGS. 1 and 2 constructed in accordance with the invention;

FIG. 5 is a perspective view of the valve tube of FIG. 4;

FIG. 6 is a side elevation view of the valve of FIG. 4;

FIG. 7 is a side view of the valve assembly of FIG. 4;

FIG. 8 is a front perspective view of the valve gate of FIG. 6;

FIG. 9 is a rear perspective view of the valve gate of FIG. 6;

FIG. 10 is a partial perspective view of an alternate spout construction provided with a valve;

FIG. 11 is a perspective view of an alternate embodiment of the paintball reservoir;

FIG. 12 is a exploded perspective view of a commercially available paintball canister used to package and hold paintballs prior to use;

FIG. 13 is a view of the open canister of FIG. 12 fitted with the valve of FIG. 4;

FIG. 14 is a front elevation view of the reservoir of FIG. 4;

FIG. 15 is a perspective view of a connector for removably connecting the conduit of FIG. 1 directly to a paintball marker;

FIG. 16 is a front elevation view of a paintball marker having its hopper communicating with the reservoir via the connector of FIG. 15;

FIG. 17 is a side elevation view of an alternate embodiment of a valve assembly adapted for use with the dispensing apparatus of FIG. 1;

FIG. 18 is a perspective view of an alternate embodiment of the valve tube of FIG. 5, modified to operate with the pair of valve gates of FIG. 17;

FIG. 19 is a side elevation view of one of the valve gates of FIG. 17;

FIG. 20 is a front perspective view of the valve gate of FIG. 19; and

FIG. 21 is a rear perspective view of the valve gate of FIG. 19.

In the various figures of the drawings, like reference characters designate like parts.

DETAILED DESCRIPTION OF THE PREFERRED EMBODIMENT

The present invention will now be described in conjunction with the drawings, beginning with FIGS. 1 and 2 which depict a paintball marker operator 10 firing a paintball marker 12. Although the paintball marker is shown as a pistol, a rifle or any other type of paintball firing or launching device may be used with the invention and these are to be understood to be generally included within the term "marker".

Marker 12 is provided with an open hopper 14 which may hold up to one hundred or more paintballs 16. The hopper feeds the paintballs into a firing chamber from which the balls are fired in a known fashion under pressure provided by a compressed gas cylinder 17.

As further seen in FIG. 1, the operator 10 is simultaneously firing paintballs 16 from marker 12 held in one hand and, with the other hand, loading paintballs 16 into hopper 14 from a dispensing apparatus 18 constructed in accordance with the invention. The dispensing apparatus 18 includes a container or reservoir 20 (FIG. 2) which is adapted to hold up to 1000 or more paintballs 16. A cap or door 19 is provided on the top of the reservoir for loading and reloading paintballs into the reservoir. A swing hinge 21 may be formed homogeneously with the cap and reservoir by molding.

A spout 22 having a funnel shape with a tapering cross section with an included angle A of about 35° is provided on a bottom corner of reservoir 20 for channeling and funneling paintballs into a flexible conduit 24. As shown in dashed lines in FIG. 2, the spout 22 which projects from a bottom side portion of the reservoir may be turned to either side of the operator 10 to accommodate right or left hand operation of the dispensing apparatus 18. A hand operated valve assembly 26 is provided on the free end of conduit 24 for selectively dispensing paintballs 16 into the hopper 14 of paintball marker 12.

The dispensing apparatus 18, which includes the reservoir 20, spout 22, conduit 24 and valve assembly 26 may be conveniently carried on the body of a carrier such as operator 10 with the aid of a mounting such as a harness, belt, strap, knapsack or any other suitable attachment device including hook and loop fasteners of the type sold under the brand Velcro. As seen in FIGS. 1 and 2, a harness 28 connected to the reservoir 20 conveniently mounts the reservoir to the back of the operator 10. In this position the reservoir 20 is held out of the way of the operator as the operator fires the marker 12.

Although the straps of harness 28 can be attached directly to the reservoir 20 as shown in FIGS. 1 and 2 such as by adhesive bonding, stitching, or fasteners such as rivets, it is also possible to carry the reservoir 20 in a backpack, pouch or carrier 30 such as shown in FIG. 3. In this case the carrier 30 is formed as a pouch with a pair of opposed openings 32 for allowing the spout 22 of reservoir 20 to project outwardly from either side of the carrier as shown in dashed lines.

Carrier 30 also includes a pair of shoulder straps 34 stitched or otherwise fastened to the inner face of the pouch, a waist or chest belt 36 and a top cover flap 38 which together form a backpack. Hook and loop fasteners 40 or any other fasteners may be used to hold the belt 36 and cover flap 38 closed. Although such a pouch or backpack arrangement is generally preferred for carrying the reservoir 20, it is of course possible to mount and carry the reservoir on one's chest or stomach area using a suitably modified harness or carrier.

Details of the assembly of the reservoir, spout, conduit and valve are provided in FIG. 4 wherein the spout and reservoir are shown as a one-piece homogenous blow-molded or injection-molded plastic container. A detachable connection 42 is provided between the reservoir 20 and conduit 24 in the form of a bayonet connection.

A cylindrical collar 44 is formed on the free end of spout 22 and a cylindrical sleeve 46 is formed on one end of conduit 24. A pair of pins 48 on collar 44 is adapted to fit within a pair of L-shaped slots 50 formed in sleeve 46 to provide a secure push-and-turn connection therebetween.

Conduit 24 is formed of a flexible hose material preferably a plastic material, with a length of about 12 to 36 inches and an inner diameter of about two inches. Smooth-walled tubing performs well, although corrugated tubing may also be used. It has been found that in most cases, a preferred length of at least about 18 inches up to about 30 inches performs well. An ideal length for the conduit is about 24 inches.

Conduit 24 can be formed homogeneously with sleeve 46 and sleeve 52 as a one-piece plastic molding. Alternatively, the sleeves 46, 52 may be separately formed and attached to the ends of the central tube portion 54 with adhesives or the like. A retainer such as a strap, line or elastic cord such as a bungee cord 55 can be connected or hooked at one end to the belt of the operator 10 as shown in FIG. 1, and hooked or otherwise fastened at the other end to the conduit 24 so that the conduit is held in front of or at the side of the operator for ready access when not in use.

Valve assembly 26 includes a short tube 56 having an inner diameter dimensioned to form a secure, tight, sliding friction-fit over the outer cylindrical surface of sleeve 52. In this manner, the valve assembly 26 can be manually inserted and removed from sleeve 52 and used for other purposes as discussed below.

A valve gate 58 in the form of a circular plastic flap or door is pivotally mounted on the end of tube 56. As seen in FIGS. 4 and 5, a pair of stub shafts or trunnions 60 is molded to the upper edge of tube 56 for securing the valve gate 58 to the end of tube 56.

The valve gate 58 is formed with a pair of resilient plastic C-shaped hinge hooks 62. Each hook 62 is dimensioned for form a secure snap-fit over-center connection around each respective stub shaft 60. As best seen in FIG. 6, a resilient plastic leaf spring 64 is formed on the rear surface of the valve gate 58 to provide a biasing force when the valve gate is snapped onto the tube 56.

A finger-operated valve actuator in the form of trigger 66 is formed on valve gate 58 between the pair of hinge fingers or hooks 62. When trigger 66 is pulled from its normally at rest position as shown in FIG. 7, the valve gate 58 pivots upwardly as shown in broken lines, thereby opening conduit 24 and allowing the release of paintballs 16 into the paint marker such as shown in FIG. 1.

Additional details of the valve gate 58 are shown in FIGS. 8 and 9 wherein gate 58, hinge fingers or hooks 62, leaf spring 64 and trigger 66 are shown formed as a one-piece plastic molding. Of course many other valve gate configurations may be used in practicing the invention such as a radially-pleated cone-shaped valve which can be opened with a simple radial squeeze in the manner a pocket coin holder. Another form of valve gate is discussed below.

Although reservoir 20 can be provided as an empty container and subsequently loaded with paintballs 16, it can also be provided in a pre-loaded form with up to 1000 or more paintballs held therein. In this case, a stopper or cover such as a slide valve or gate 68 shown in FIG. 10 is required to hold the paintballs in the reservoir prior to use. Once the reservoir 20 is connected to the conduit 24 and the operator desires to dispense paintballs from the reservoir through the conduit into a paintball marker 12, the operator opens valve by pulling gate 68 out of slot 70 formed in collar 44. The gate 68 may be held in slot 70 with a simple friction fit.

Although spout 22 is advantageously directed to one side of the reservoir 20, it can, as an alternative embodiment, be located centrally on the bottom portion of reservoir 20 as shown in FIG. 11. In this case carrier 30 can be formed with a central port or opening 32 for the passage of spout 22 therethrough.

Another modification or variation of the invention is seen in FIGS. 12 and 13 wherein a commercially available paintball canister 72 is shown loaded with paintballs 16. A cap 74 is provided on the canister to hold the paintballs therein prior to use. When an operator 10 needs to reload hopper 14, the operator removes cap 74 and pours at least some of the contents of canister 72 into the hopper. Cap 74 is typically discarded or replaced on the canister if some paintballs remain in the canister.

Rather than replace cap 74 on canister 72, the valve assembly 26 of FIG. 7 may be used in its place as shown in FIG. 13. The tube 56 of valve assembly 26 is dimensioned to form a tight sliding friction fit over the surface of canister 72. This generally requires the inner diameter of the tube 26 to be about two inches in diameter.

In this manner, the paintballs in canister 72 can be selectively dispensed, in whole or in part, by pulling trigger 66 and pouring as many paintballs as required into hopper 14. By reloading the paintball marker with the modified valved canister shown in FIG. 13, the operator 10 can reload with one hand. Two hands are not needed to close the canister by replacing the cap 74 with one hand while holding the canister 72 with the other hand.

As noted above, the spout 22 tapers and converges over an included angle A of about 35°. Angle A is shown in more detail in FIG. 14 along with additional details of the reservoir 20. In particular, angle B is advantageously set at about 125° and angle C is set at about 160°. This defines or sets angle A at about 35° with the side walls of the reservoir 20 being parallel to one another.

Another variation and embodiment of the invention is shown in FIGS. 15 and 16 wherein a connector 78 is shown attached to the free end of conduit 24 and to the hopper 14 of paintball marker 12. Connector 78 includes a tube 56 dimensioned the same as tube 56 on valve assembly 26 so that the connector can be attached to sleeve 52 with a sliding friction fit.

Connector 78 further includes a plurality of spring detent fingers 80 extending outwardly or axially in a circular array from tube 56. Each finger 80 ends in a radially-outwardly directed hook portion 82 which, as seen in FIG. 16, resiliently snaps under the edge or lip 84 surrounding the opening on the top of hopper 14. In this manner, connector 78, which may be molded from a resilient plastic material, may be snapped into and removed from the hopper 14.

When the conduit 24 is removably attached to hopper 14 via connector 78, the paintballs 16 will be continuously fed into the hopper from the reservoir 20. The continuous flow can be interrupted by the use of a valve or gate 68 as shown in broken lines in FIG. 15. In this case, a slot 70 is formed in tube 56 to receive gate 68 with a friction fit to function in the same manner as the gate 68 of FIG. 10 discussed above.

In some cases an operator may be distracted or need to act quickly while filling the hopper 14 and thereby unintentionally overfill the hopper causing paint balls to fall out of the hopper. In order to minimize this possibility, the valve assembly 26 of FIG. 17 may be connected to sleeve 52 and operated in the same general manner as described above with respect to valve assembly 26 of FIG. 7. However, the valve assembly 26 of FIG. 17 includes a door formed by a pair of spoon-shaped valve gates 58 which project forwardly from tube 56 in the manner of a duck bill for insertion into the hopper 14.

As seen in FIG. 18, tube 56 is formed with two pairs of stub shafts 60 for pivotally supporting each valve gate 58 via hinge fingers or hooks 62 as described above. Each valve gate 58 further includes a leaf spring 64 for biasing each valve gate 58 toward one another in the manner of a bird's beak to form a normally closed duck bill type valve. As seen in FIGS. 19, 20 and 21, each valve gate 58 has a generally spade shaped profile to facilitate insertion within hopper 14.

As further seen in FIG. 17, when the triggers 66 are pivoted toward tube 56, the valve gates 58 swing apart and open to allow paintballs to flow freely into hopper 14. In use, the spoon shaped gates 58 are inserted into hopper 14 while closed against one another. The triggers 66 are then pulled and held open until the paint balls stop flowing. The triggers are then released thereby closing the valve gates 58.

After the valve gates 58 are closed, the valve assembly 26 is removed from within the mouth of the hopper. In this manner, the paint balls are prevented from overflowing the hopper and from spilling out of the tube 56. This dual valve gate valve assembly may also be used on a canister 72 as shown in FIG. 13.

There has been disclosed heretofore the best embodiment of the invention presently contemplated. However, it is to be understood that the various changes and modifications may be made thereto without departing from the spirit of the invention.

What is claimed:

1. A dispenser for dispensing paintballs, comprising:

a reservoir;

a plurality of paintballs disposed in said reservoir;

a spout communicating with said reservoir;

a flexible conduit communicating with said spout; and a valve communicating with said conduit for metering paintballs through said conduit.

2. The dispenser of claim 1, further comprising a mounting provided on said dispenser for mounting said dispenser on a carrier.

3. The dispenser of claim 2, wherein said mounting comprises a harness and said carrier comprises a paint marker operator.

4. The dispenser of claim 3 further comprising a carrying pouch attached to said harness.

5. The dispenser of claim 4, wherein said harness and said carrying pouch form a backpack.

6. The dispenser of claim 4, wherein said carrying pouch has an opening formed therein and wherein said spout projects through said opening.

7. The dispenser of claim 1, wherein said spout comprises a cross section which tapers from said reservoir to said conduit.

8. The dispenser of claim 1, further comprising a door provided on said reservoir for loading paintballs into said reservoir.

9. The dispenser of claim 1, wherein said valve comprises a hand operated sliding gate valve provided on said spout.

10. The dispenser of claim 1, wherein said reservoir comprises a top portion and a bottom portion and wherein said spout is provided on said bottom portion.

11. The dispenser of claim 10, wherein said bottom portion comprises a first side portion and an opposite second side portion and wherein said spout is provided on said first side portion.

12. The dispenser of claim 10, wherein said bottom portion comprises a central portion and wherein said spout is provided on said central portion.

13. The dispenser of claim 1, further comprising a retainer provided on said conduit for holding said conduit in a preferred position.

14. The dispenser of claim 1, further comprising a detachable connection located between said reservoir and said conduit.

15. The dispenser of claim 4, wherein said detachable connection comprises a bayonet connection formed between said conduit and said spout.

16. The dispenser of claim 1, further comprising a detachable connection located between said conduit and said valve.

17. The dispenser of claim 16, wherein said detachable connection comprises a sliding friction fit connection formed between said conduit and said valve.

18. A paintball marker assembly, comprising:

a paintball marker;

a reservoir for storing and dispensing paintballs into said marker; and a flexible conduit interconnecting said reservoir and said marker.

19. The assembly of claim 18, further comprising a hopper provided on said marker, and wherein said conduit is connected to said hopper.

20. The assembly of claim 19 wherein said conduit is detachably connected to said hopper.

21. The assembly of claim 18, further comprising a mounting provided on said reservoir for mounting said reservoir to a carrier.

22. The assembly of claim 21, wherein said mounting comprises a strap and said carrier comprises a marker operator.

23. The assembly of claim 21, wherein said mounting comprises a backpack.

24. The assembly of claim 18, further comprising a plurality of paintballs provided in said reservoir.

25. A paintball dispenser, comprising:

a reservoir;

a plurality of paintballs provided in said reservoir; and an elongated conduit communicating with said reservoir for channeling said paintballs into a paintball marker.

26. The dispenser of claim 25, wherein said conduit comprises a flexible conduit.

27. The dispenser of claim 25, wherein said conduit is at least 18 inches long.

28. A paintball dispenser for storing and dispensing paintballs, comprising:

a reservoir adapted to hold and dispense said paintballs;

a flexible conduit having one end communicating with said reservoir and another free end;

a spring biased valve provided over said free end of said conduit in a normally closed position; and a finger operated trigger connected to said valve for opening said valve and metering said paintballs from said reservoir, through said conduit, through said valve and into a paintball marker.

29. A paintball dispenser for storing and dispensing paintballs comprising:

a reservoir adapted to hold and dispense said paintballs;

a flexible conduit having one end communicating with said reservoir and another free end; and a hand-operated pivoting flap valve resiliently biased in a normally closed position across said free end of conduit.

* * * * *